US009016172B2

(12) United States Patent
Liao et al.

(10) Patent No.: US 9,016,172 B2
(45) Date of Patent: Apr. 28, 2015

(54) HAMMER

(71) Applicants: Ying-Chieh Liao, Taichung (TW); Yu-Kuo Liao, Taichung (TW)

(72) Inventors: Ying-Chieh Liao, Taichung (TW); Yu-Kuo Liao, Taichung (TW)

( * ) Notice: Subject to any disclaimer, the term of this patent is extended or adjusted under 35 U.S.C. 154(b) by 205 days.

(21) Appl. No.: 13/904,964

(22) Filed: May 29, 2013

(65) Prior Publication Data

US 2014/0352498 A1 Dec. 4, 2014

(51) Int. Cl.
*B25D 1/14* (2006.01)
*B25D 1/02* (2006.01)

(52) U.S. Cl.
CPC ... *B25D 1/14* (2013.01); *B25D 1/02* (2013.01)

(58) Field of Classification Search
CPC ..... B25D 1/02; B25D 1/08; B25D 1/12; B25D 1/14; B25D 1/16
USPC ..... 81/25–27, 20, 22
See application file for complete search history.

(56) References Cited

U.S. PATENT DOCUMENTS

| | | | | | |
|---|---|---|---|---|---|
| 2,451,217 | A * | 10/1948 | Heinrich | 81/22 |
| 3,130,762 | A * | 4/1964 | Kerr | 81/25 |
| 3,253,329 | A * | 5/1966 | Lehn | 29/275 |
| 3,948,301 | A * | 4/1976 | Hays | 81/26 |
| 4,355,671 | A * | 10/1982 | Senior, III | 144/195.5 |
| 4,831,901 | A * | 5/1989 | Kinne | 81/25 |
| 6,128,977 | A * | 10/2000 | Gierer et al. | 81/22 |
| 6,928,899 | B1 * | 8/2005 | Lin | 81/25 |
| 2012/0024554 | A1 * | 2/2012 | Boehm et al. | 173/162.2 |

* cited by examiner

*Primary Examiner* — David B Thomas

(57) ABSTRACT

A hammer includes a handle, a head portion, and a striking mechanism. The head portion is connected with the handle and includes a metal strike element and a resilient strike element. A receiving space is defined between the two strike elements. The striking mechanism is located in the receiving space and includes a slide axle and a striking member. The striking member has a through hole for being slidably sleeved onto the slide axle. The striking member is slidable in the receiving space to alternatively strike one end of the head portion. Thereby, inertia striking force is provided by the striking member so that the hammer can be used to strike an object more easily.

9 Claims, 3 Drawing Sheets

HAMMER

BACKGROUND OF THE INVENTION

1. Field of the Invention

The present invention relates to a striking tool, more especially to a hammer.

2. Description of the Prior Art

A hammer is a widely-used tool for striking. Specifically, hammers with different materials are adapted for striking different work pieces. For example, a steel hammer is adapted for metal work pieces such as nails, and a wooden or rubber hammer is adapted for modeling.

Some striking tools have handles with shock-absorbing mechanism or anti-slipping mechanism. For example, as shown in patent TW 424657, an axial receiving trough is formed in the handle, and plural shock-absorbing balls are received in the receiving trough. When the striking tool is used for striking an object, the shock-absorbing balls may move to the top of the receiving trough. Thereby, shock by the reaction force may be alleviated by the shock-absorbing balls.

Besides, smaller hammers for striking tiny work pieces have smaller mass, so smaller momentum can be provided. Thus, it is arduous to strike objects. On the other hand, patent TW 136461 disclosed a hammer with a core and a sleeve wherein the core is able to move along a specific direction for striking again. However, the structure is complicated and may be broken easily.

SUMMARY OF THE INVENTION

The main object of the present invention is to provide a hammer which has a simple structure and is more effective.

To achieve the above and other objects, a hammer of the present invention includes a handle, a head portion, and a striking mechanism.

The head portion is connected with an end of the handle and includes two strike elements. The two striking faces include a metal strike element and a resilient strike element which is made of resilient material. The striking mechanism is located in the receiving space and includes a slide axle and a striking member. The striking member has a through hole for being sleeved onto the slide axle. Thereby, the striking member is slidable in the receiving space and is able to alternatively strike an end of the head portion having the metal strike element or an end of the head portion having the resilient strike element.

Thereby, inertia striking force is provided to the strike elements by the striking member. Thus, the hammer can be used for striking objects more effectively.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
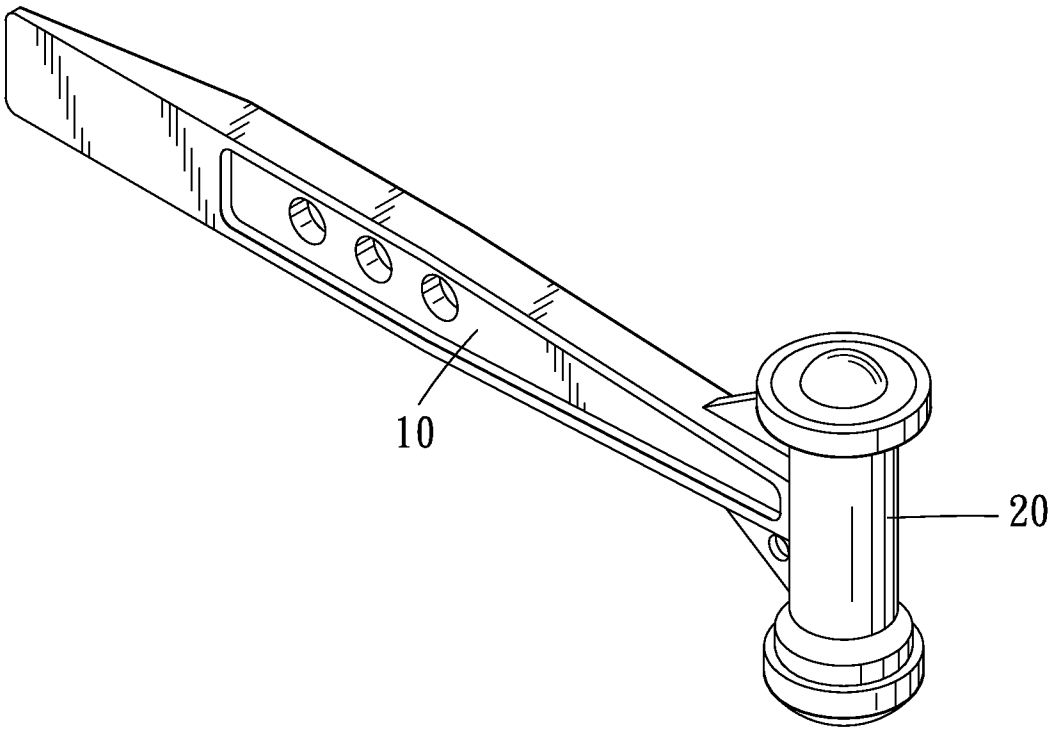
FIG. 1 is a stereogram showing a hammer of the present invention.
Figure 2:
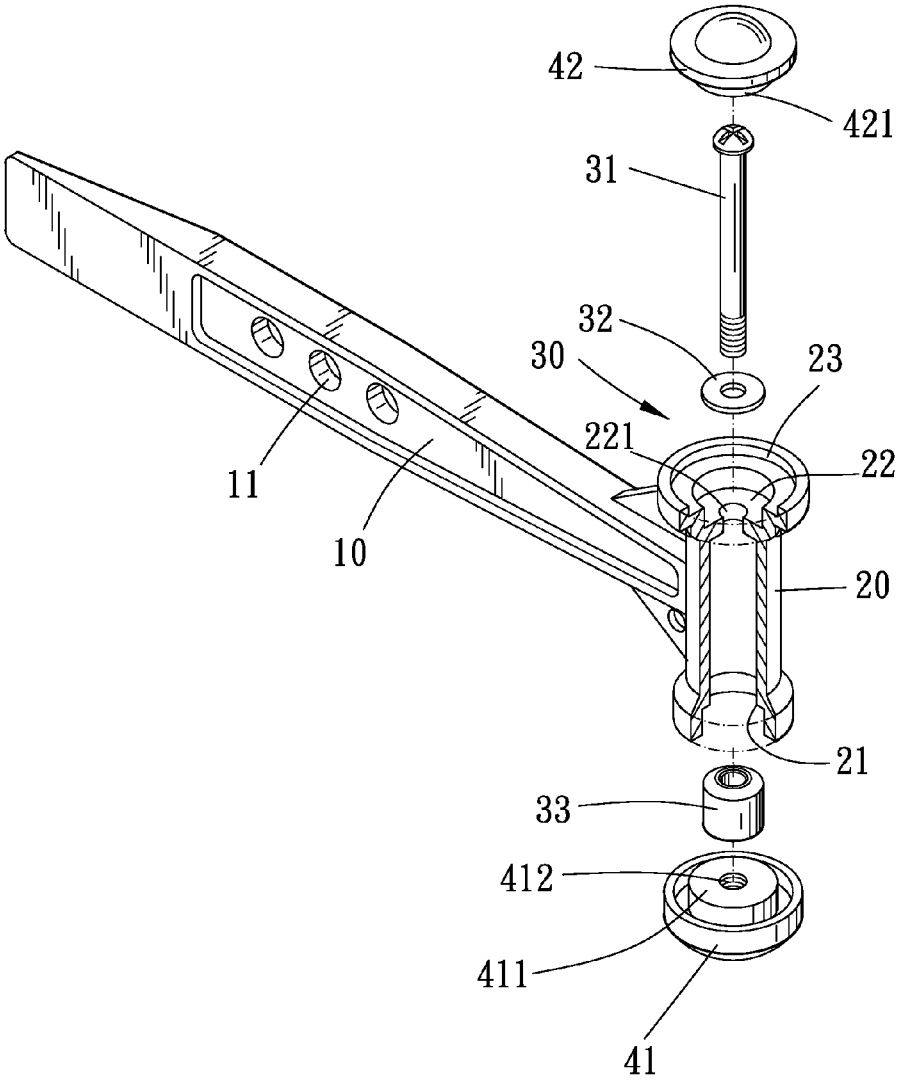
FIG. 2 is a breakdown drawing showing a hammer of the present invention.

Please refer to FIG. 1 and FIG. 2, the hammer of the present invention includes a handle 10, a head portion 20, and a striking mechanism 30. The head portion 20 is connected with an end of the handle 10 and includes two strike elements. A receiving space is defined between the two strike elements. Specifically, the two strike elements includes a metal strike element 41 and a resilient strike element 42 which is made of resilient material such as rubber. The striking mechanism 30 is located in the receiving space and includes a slide axle and a striking member 33. The striking member 33 has a through hole for being slidably sleeved onto the slide axle. Thereby, the striking member 33 is slidable in the receiving space and is able to alternatively strike an end of the head portion 20 having the metal strike element 41 or an end of the head portion 20 having the resilient strike element 42.

In the preferred embodiment of the present invention shown in FIG. 2, the handle 10 and the head portion 20 are formed integrally by means such as plastic injection molding. The handle 10 has a plurality of suspension holes 11 for suspension of the hammer. The head portion 20 is cylinder-shaped, and the receiving space is also cylinder-shaped. The substantial shape of the head portion is similar to the shapes of conventional striking tools. On the other hand, the receiving space of the head portion 20 has an open end portion 21 and a closed end portion 22 at two ends respectively. An aperture 221 is formed on a center of the closed end portion 22. The two strike elements 41, 42 are preferably detachable. However, it is feasible that only one of the strike elements is detachable for the striking mechanism entering the receiving space. A threaded hole 412 is formed on a center of an inner face of the metal strike element 41.

The head portion 20 has a receiving trough 23 located outside each of the open end portion 21 and the closed end portion 22. Each receiving trough 23 is adapted for receiving one of the metal strike element 41 and the resilient strike element 42. Preferably, the metal strike element 41 is disposed on the open end portion 21, and the resilient strike element 42 is disposed on the closed end portion 22. Specifically, the metal strike element 41 forms a cylinder-shaped first protrusion 411 and an annular groove around the first protrusion 411. The threaded hole 412 is formed on the first protrusion 411. The first protrusion 411 is disposed in the receiving trough 23 beside the open end portion 21, and the annular groove is engaged with an outer periphery of the open end portion 21. The resilient strike element 42 is substantially circular plate-shaped, and a circular second protrusion 421 is formed on the resilient strike element 42. A cylinder-shaped space is formed in the second protrusion 421. The second protrusion 421 is disposed in the receiving trough 23 beside the closed end portion 22.

Figure 3:
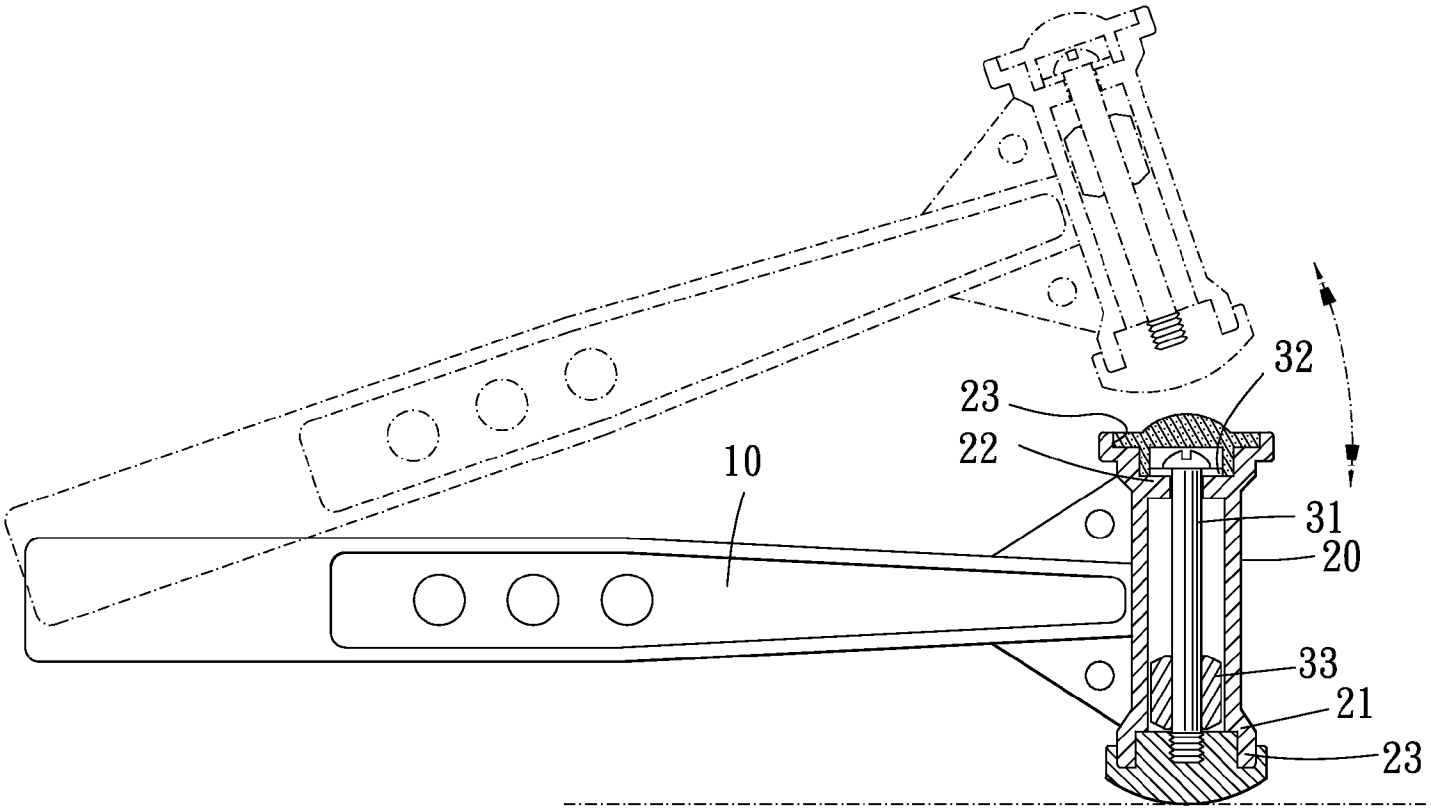
FIG. 3 is an illustration of operation showing a hammer of the present invention.

Please refer to FIG. 2, the slide axle of the striking mechanism 30 includes a threaded rod 31. The striking mechanism 30 further includes an abutting piece 32. The threaded rod 31 is inserted through the abutting piece 32 with a hole and is further inserted through the aperture 221 of the closed end portion 22 so that the threaded rod 31 is partially received in the receiving space. A head of the threaded rod 31 is located between the closed end portion 22 and the resilient strike element 42, and the abutting piece 32 is sandwiched between the head of the threaded rod 31 and the closed end portion 22. Thereafter, the striking member 33 is placed into the receiving space from the open end portion 21. The striking mechanism 30 is adapted for increasing force of striking, so a heavy and hard object has to be provided for inertia striking force. Thus, the striking member 33 is preferably cylinder-shaped and is made of metal. The striking member 33 forms a through hole so that the threaded rod 31 is able to be inserted through the through hole and that the striking member 33 is thereby sleeved onto the threaded rod 31. Thus, the striking member 33 is able to slide in the receiving space along the threaded rod 31. The metal strike element 41 is disposed beside the open end portion 21, and an end of the threaded rod 31 opposite to the head is screwed with the threaded hole 412 on the first protrusion 411. In use, referring to FIG. 3, the sliding striking member provides an inertia momentum for increasing striking force.

In conclusion, the hammer of the present invention provides a striking mechanism which provides inertia striking force to increase striking force. In addition, the inertia momentum has a same direction with the direction in which the hammer is moved, so a user can strike an object with the hammer of the present invention with less force.

What is claimed is:

1. A hammer, comprising:

a handle;

a head portion, connected with an end of the handle, the head portion including two strike elements, a receiving space being defined between the two strike elements, the two strike elements including a metal strike element and a resilient strike element which is made of resilient material; and a striking mechanism, located in the receiving space, including a slide axle and a striking member, the striking member forming a through hole, the slide axle being inserted through the through hole so that the striking member is slidably sleeved onto the slide axle;

wherein the striking member is slidable in the receiving space and is able to alternatively strike an end of the head portion having the metal strike element or an end of the head portion having the resilient strike element.

2. The hammer of claim 1, wherein at least one of the strike elements is detachable.

3. The hammer of claim 2, wherein the two strike elements are both detachable.

4. The hammer of claim 1, wherein an open end portion and a closed end portion are located at two ends of the receiving space respectively, an aperture is formed on the closed end portion.

5. The hammer of claim 4, wherein the metal strike element is disposed outside the open end portion, the resilient strike element is disposed outside the closed end portion.

6. The hammer of claim 5, wherein the slide axle includes a threaded rod, the threaded rod is inserted through the aperture of the closed end portion and enters the receiving space so that a head of the threaded rod is located between the closed end portion and the resilient strike element, the metal strike element is formed with a threaded hole, the threaded hole is adapted for screwing with an end of the threaded rod opposite to the head.

7. The hammer of claim 1, wherein the striking member is made of metal.

8. The hammer of claim 1, wherein the handle and the head portion are formed integrally by plastic injection molding.

9. The hammer of claim 1, wherein the handle has a plurality of suspension holes.

* * * * *